United States Patent [19]

Kobler

[11] Patent Number: 4,833,986

[45] Date of Patent: May 30, 1989

[54] HOLDING AND TENSIONING SYSTEM FOR A COVER LAYER ON A PRINTING MACHINE CYLINDER

[75] Inventor: Ingo Kobler, Anhausen, Fed. Rep. of Germany

[73] Assignee: M.A.N. Roland Druckmaschinen AG, Offenbach am Main, Fed. Rep. of Germany

[21] Appl. No.: 162,063

[22] Filed: Feb. 29, 1988

[30] Foreign Application Priority Data

Mar. 5, 1987 [DE] Fed. Rep. of Germany ..... 3707066

[51] Int. Cl.[4] ..... B41F 13/12; B41F 27/00; B41F 7/22

[52] U.S. Cl. ..... 101/415.1; 101/378

[58] Field of Search ..... 101/415.1, 378, 409, 101/410; 51/367, 368, 364

[56] References Cited

U.S. PATENT DOCUMENTS 1,927,728 9/1933 Wolff ..... 101/415.1

3,230,883 1/1966 Achinger et al. ..... 101/415.1

FOREIGN PATENT DOCUMENTS 0248695 8/1987 Fed. Rep. of Germany ... 101/415.1

*Primary Examiner*—Edgar S. Burr

*Assistant Examiner*—Kimberly L. Asher

*Attorney, Agent, or Firm*—Frishauf, Holtz, Goodman & Woodward

[57] ABSTRACT

To permit uniformly tensioning a holding strip (11) in which end portions (22, 23) of a cover layer such as a rubber blanket (24) can be inserted, the strip (11) is coupled to a plurality of rods (9) extending radially inwardly, and uniformly distributed over the axial length of the strip (11), the rods (9) being coupled to respective pistons (5) slidable in cylinder bores (4) worked in the bottom of the groove (2). Hydraulic or pneumatic pressure can be applied to one face of the piston, the opposite face of the piston being loaded by a spring (17). Thus, since the pressure being applied to all the pistons will be uniform, tensioning pressure (FIG. 2) will be uniform, or raising pressure (FIG. 3) will be uniform. Rather than using fluid pressure, other non-mechanical energy, such as electrical energy, can be used to raise the strip (11) by electromagnetic coupling of solenoids to the rods (9).

15 Claims, 2 Drawing Sheets

HOLDING AND TENSIONING SYSTEM FOR A COVER LAYER ON A PRINTING MACHINE CYLINDER

Reference to related patent, the disclosure of which is hereby incorporated by reference: U.S. Pat. No. 2,209,127.

The present invention relates to printing machines, and more particularly to a holding and tensioning arrangement to hold and tighten a cover layer over a cylinder of the printing machine, and particularly to tighten a rubber blanket over a blanket cylinder of a rotary offset printing machine.

BACKGROUND

Covers which are applied to cylinders of rotary printing machines are preferably stretched thereabout. A holding, stretching or tensioning arrangement for a printing machine cylinder cover is described in the referenced U.S. Pat. No. 2,209,127, the disclosure of which is hereby incorporated by reference. This reference teaches holding printing plates on a plate cylinder, using a tensioning and holding arrangement in which two ends of a substrate carrying the printing plate as such are introduced into recesses of a clamping strip. The recesses are located on circumferentially even levels. The tensioning strip is then tightened by screws extending therethrough and threaded in the bottom of the cylinder groove, to move the tensioning strip in the direction of the center of the cylinder.

It has been found that it is difficult to obtain uniform tensioning of the cover across the axial extent of the cylinder since a plurality of screws, distributed over the length of the cylinder must be tightened. Uniform tightening of the screws at the same time is necessary for uniform stretching of the cover. To uniformly tighten a plurality of screws requires either a substantial number of operators or machinists, with consequent high personnel cost, or an expensive and complex apparatus.

THE INVENTION

It is an object to provide a tensioning and holding arrangement for a cover on a printing machine, and especially for a rubber blanket cover for a blanket cylinder of an offset printing machine, in which a single tensioning point can cause uniform application of tension over the axial length of the cylinder to a cover layer thereover.

Briefly, the cylinder groove, usually present in printing machine cylinders, is formed with recesses in which a plurality of rod elements are retained, which are coupled to a holding strip, extending axially across the cylinder and retaining the ends of the cover. Direct non-mechanical energy is applied to the rods, for example by attaching a piston head on the rods, and applying hydraulic or pneumatic force thereagainst, to pull the rods inwardly, and hence to move the tensioning strip inwardly and thereby tighten the cover layer; alternatively, the system can be reversed, and springs used to pull the cover layer, attached to the tensioning strip, with fluid pressure being used to raise the bolt elements for release of the cover layer. Alternatively, the rod elements can be pulled inwardly, or raised against inwardly directed spring pressure by electrical solenoids. The energy supply—be it a compressed fluid or electrical energy—can then be coupled to the rod elements, in the form of solenoid plungers or piston units, from a position remote from the area on the cylinder covered by the blanket, for example an end face of the cylinder, or some other location.

The system has the advantage that uniform tensioning force is applied to the strip throughout the entire axial length, by applying uniform energy to the bolt elements, simultaneously. It is a simple matter, thus, for a single operator, to apply a cover over a cylinder, in minimum time, and with minimum apparatus. Compressed air or hydraulic fluid under pressure or electrical energy is customarily available in print shops.

Drawings illustrating exemplary embodiments:

The term "non-mechanical energy", as used herein, is intended to convey the concept of lack of any direct mechanical coupling of elements, for example by pull rods, spindles, screws, gears or the like; rather, the transfer of energy is electrical, electromagnetic, or by fluid pressure.

DETAILED DESCRIPTION

Figure 2:
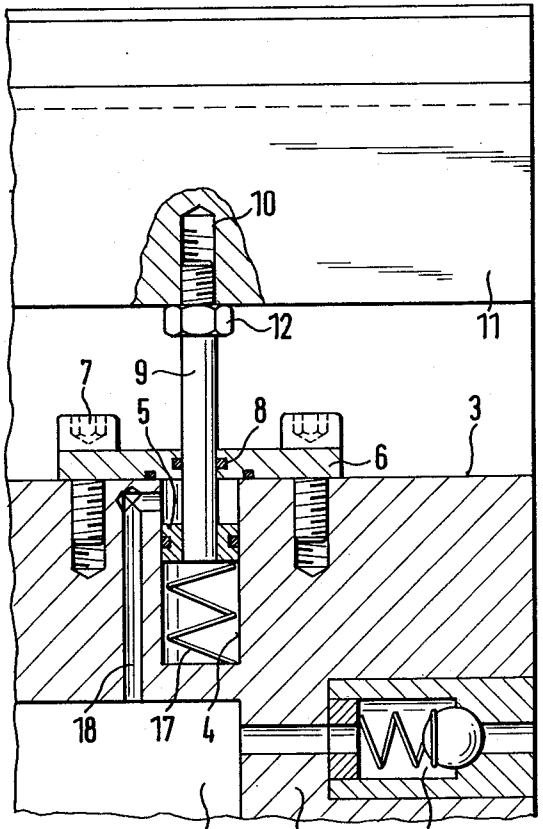
FIG. 2 is a fragmentary enlarged view illustrating the tensioning and holding system of the present invention.
Figure 3:
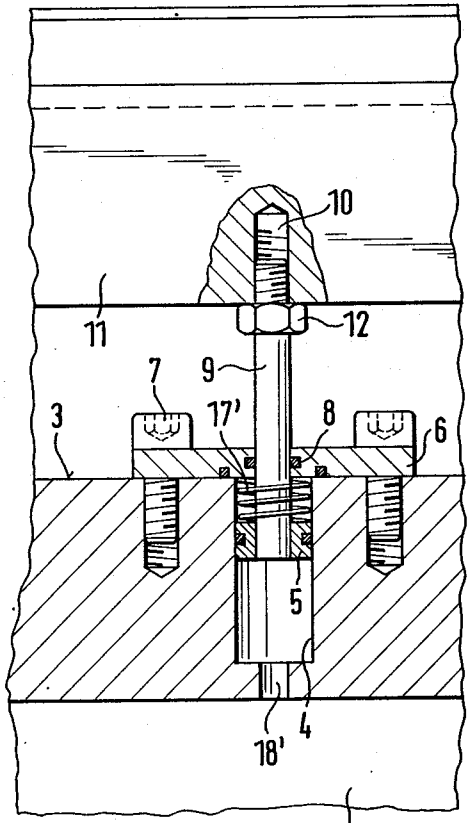
FIG. 3 is a longitudinal sectional view through another embodiment of the clamping arrangement.

A rubber blanket cylinder 1 has a clamping groove 2 extending axially thereacross, as is well known. The groove 2 has an essentially rectangular cross section, and has a generally axially extending bottom wall 3 (FIG. 2). The groove 2 extends further radially inwardly, either as a continuous groove portion or, and as shown in FIGS. 2 and 3, in the form of individual recesses 4 which are blind bores and form operating cylinders for a piston 5 movable in the bores 4. The bores 4 are closed off by cover plates 6 with respect to the wall 3 of the upper portion of the groove 2. The cover plates 6 are secured by screws 7 in bottom 3 and formed with a central bore 8 through which a piston rod 9, secured to the piston 5, extends upwardly from the recesses or bores or cylinders 4. The free ends of the piston rods 9 are tapped and threaded into threaded bores 10 cut in the bottom side of a tensioning strip 11 extending axially across the groove 2. The rods 5, of course, can be individually threaded into the bores 10 and then tightened in position by a counter nut 12 to provide for precise adjustment of the spacing between the pistons 5 and individual portions of the strip 11.

Figure 1:
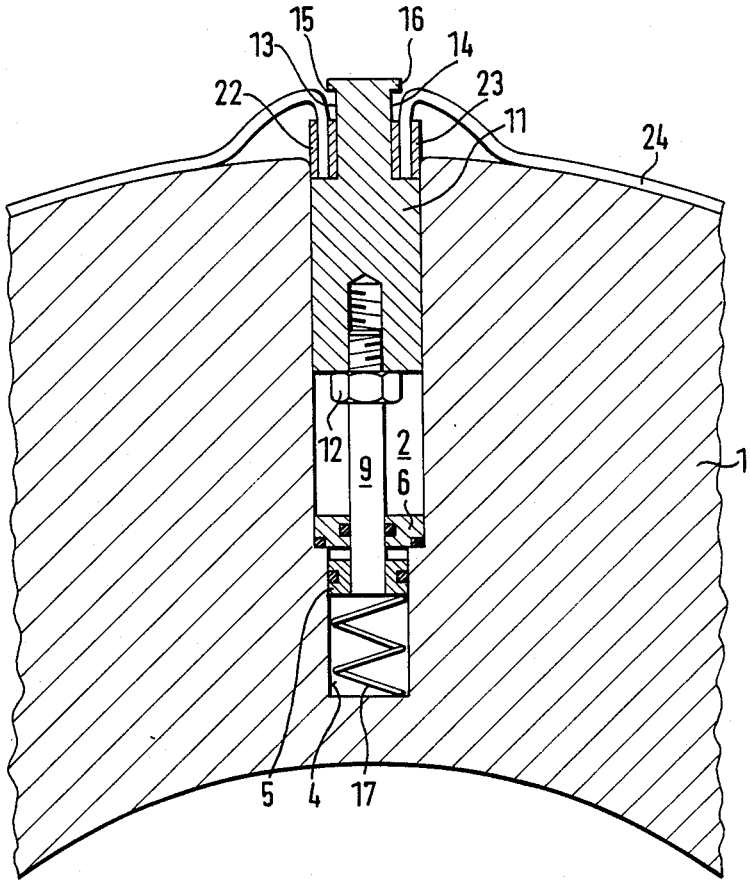
FIG. 1 is a fragmentary radial cross-sectional view through a rubber blanket cylinder of a printing machine in the region of the clamping groove for a rubber blanket.

The lower part of the strip 11 has approximately the width of the groove 2. The upper part of the strip 11 is formed with two recesses 13, 14, reducing its width, to receive reinforced ends 22, 23 of a rubber blanket 24 to be placed about the cylinder (see FIG. 1). Projecting shoulders or ledges 15, 16 extend over the recesses 13, 14. In accordance with a feature of the invention, a compressed fluid supply duct 18 (FIG. 2) terminates laterally in the upper portion of the recesses 4 forming the cylinders. The supply ducts 18 communicate with a compressed fluid manifold or storage space 19. Storage space or manifold 19, located within the printing cylinder 1, is connected via a check valve 21 located in the side wall 20 of the blanket cylinder with a connection duct 21*a*, adapted for connection to a source of compressed fluid. A spring 17, located in the bottom of the recess 4, urges the piston 5, and hence the rod 9 upwardly.

OPERATION, AND ASSEMBLY OF BLANKET 24

In a base position, in which any fluid in the manifold or storage space 19 is essentially without pressure, piston 5 is urged upwardly by the force of the spring 17. The piston 5, at an upper top or dead-center position, just below the opening of duct 18, thus raises the strip 11 so that the upper end carrying the shoulders 15, 16 will extend from the blanket cylinder 1 for sufficient distance to to permit insertion of the end portions 22, 23 of the blanket 24—see FIG. 1. As can be seen, the two recesses 13, 14 are easily accessible from both sides, so that the blanket 24 can be easily fitted into the recesses. The end portions 22, 23, as is customary, are reinforced, and the recesses 13, 14 are made to fit the reinforced end portions 22, 23.

Compressed fluid, for example compressed air, is then introduced through duct 21*a*, which will raise check valve 21 off its seat and compressed air will be applied through the ducts 18 into the cylinder space above the piston 5. When the force, which is formed by the product of fluid pressure and area of the upper side of the piston 5—and neglecting the weight of the parts to be moved and friction—exceeds the force of the spring 17, pistons 5 are moved downwardly, carrying along with it the strip 11 via the rods 9. This movement will be comparatively slow. Force is uniformly applied to all the rods 9, since the pressure in all the cylinders coupled to the manifold 19 will be the same. By suitable control of increase of the pressure of the fluid applied to the duct 21*a*, the blanket 21 can be tightened and stretched with precisely measured and defined tension, and independently of possible slight differences of length of the blanket 24 across the axis of the cylinder, since the application force due to the compressed fluid will be uniform.

To remove the rubber blanket, it is only necessary to release the check valve 21, for example mechanically or otherwise, or to open a suitable release valve, coupled to the chamber or manifold 19, and not shown since pressure release is a standard engineering matter.

FIG. 3 illustrates a variation in which the spring force-compressed fluid force relationship is reversed. In the embodiment of FIG. 2, the compressed fluid is retained in the chamber 19 and, when the blanket is in place, is held under the fluid pressure trapped into the pressurized space by the check valve 21. In the embodiment of FIG. 3, spring 17' is located above the piston 5 in the recess 4. The spring has such force that it can hold the strip 11 in the downward or base position in the groove 2. The ducts 18' are coupled radially to chamber 19 and terminate in the lower portion of the recesses 4 forming the working cylinders. Compressed fluid is then applied to the piston 5 to raise the strip 11, that is, the recess 4 is pressurized for insertion or release of a blanket 24. Application of energy to the piston 5, thus, is necessary upon exchange or removal of the blanket 24. During operation of the printing machine, no pressurized fluid will be trapped in the interior of the cylinder, that is, in the chamber or manifold 19.

Various changes and modifications may be made in accordance with the inventive concept, and features described in connection with any one of the embodiments may be used with any of the others.

Instead of compressed air, compressed oil can also be used. As energy to operate the piston 5, electromagnetic force with a current carrying coil can be applied which, for example, surrounds the lower part of the working cylinder of the piston.

Figure 4:
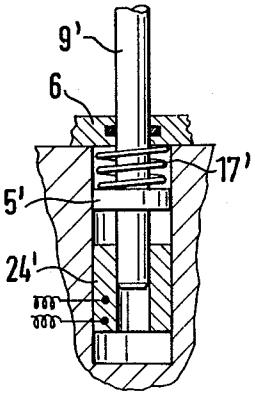
FIG. 4 is a highly schematic fragmentary view illustrating an electrical clamping arrangement.

FIG. 4 illustrates, schematically, another embodiment which relies not on the energy retained in a compressed fluid but, rather, on electrical energy. The rod 9' is formed with a longitudinal extension which dips into a solenoid 24'. FIG. 4 illustrates the arrangement when the strip 11 is raised, and solenoid 24 is energized. Connection to solenoid 24' can be done in accordance with any well known manner, for example by insulated lines, or one insulated line and using the metal of the cylinder as a return path, for energization when the cylinder is stopped, the strip 11 raised, and the blanket 24 to be inserted or exchanged. Upon release of electrical energy to the solenoid 24', the spring 17' will return rod 9' to a depressed position. Spring 17' bears against an abutment 5' on the rod 9', similar to the piston 5. This arrangement has the advantage that slip ring connections to the rotating cylinder can be avoided although, of course, the arrangement can be reversed to continuously energize the coil 5 to pull the rod 9' into the bottom position and place the spring 17 to push the rod 9' for release of the strip 11.

I claim:

1. Holding and tensioning system for a cover layer (24) on a printing machine cylinder (1), and especially for holding and stretching a rubber blanket on a blanket cylinder of an offset printing machine, comprising an axial groove (2) formed in the cylinder;

a holding strip (11) located in the cylinder and formed with laterally oppositely located recesses (13, 14) engaging end portions (22, 23) of the cover layer (24); and means for moving and securing said holding strip (11) into the groove (2) and retaining the cover layer on the cylinder at a tension uniformly applied over the axial length of the cylinder, said holding and securing means comprising, in accordance with the invention, a plurality of cylinder bores (4) formed as blind bores in the bottom (3) of the groove (2) extending inwardly of the cylinder, and uniformly distributed over the axial length of the cylinder;

a plurality of rod elements (9) coupled to said holding strip (11) and extending towards said cylinder bores;

axially movable pistons (5) secured to said rod elements (9) and operable in said cylinder bores (4);

fluid applying means to provide compressed fluid to act upon said pistons;

a cover plate (6) formed with an opening to permit passage of said rod elements (9) therethrough, covering the cylinder bores and sealing the cylinder bores against the bottom wall (3) of the groove; and circumferentially extending ledges (15, 16) extending from the outer end of said holding strip (11) at the same height, and from opposite sides thereof, and overlapping in part said recesses (13, 14) in the holding strip.

2. The system of claim 1, further including spring means (17, 17') acting on said pistons (5) in a direction opposite the direction of pressure of the compressed fluid applied against said piston upon release of pressurization of said fluid.

3. The system of claim 1, wherein said rod elements (9) are directly connected to the holding strip (11).

4. The system of claim 1, wherein the fluid applying means includes a manifold or compressed fluid chamber (19) formed in the interior of the cylinder;

means (21, 21*a*) for applying said pressurized fluid to said chamber or manifold;

and distribution ducts (18, 18') distributing the pressurized fluid under essentially equal pressure to all said cylinder bores (14).

5. The system of claim 4, further including spring means (17, 17') acting on said pistons (5) in a direction opposite the direction of pressure of the compressed fluid applied against said piston upon release of pressurization of said fluid;

and wherein the spring means (17) engage one side of the piston (5) and the distribution ducts terminate in the respective cylinder bores at the side of the piston remote from said spring means (17).

6. The system of claim 1, wherein said compressed fluid comprises compressed air.

7. The system of claim 1, wherein said means (18–21) for applying compressed fluid to said piston elements are accessible from a portion of the cylinder remote from said cover layer.

8. The system of claim 7, wherein said means for applying the compressed fluid are accessible from an end facing side wall (20) of the cylinder.

9. The system of claim 1, wherein said cover layer comprises a rubber blanket (24) having reinforced end portions (22, 23), said reinforced end portions fitting into the recesses (13, 14) of the holding strip (11).

10. The system of claim 9, wherein said extending ledges (15, 16) of said holding strip (11) overlap at least in part the reinforced end portions (22, 23) of the blanket (24).

11. Holding and tensioning system for a cover layer (24) on a printing machine cylinder (1), and especially for holding and stretching a rubber blanket on a blanket cylinder of an offset printing machine, comprising an axial groove (2) formed in the cylinder;

a holding strip (11) located in the cylinder and formed with laterally oppositely located recesses (13, 14) engaging end portions (22, 23) of the cover layer (24); and means for moving and securing said holding strip (11) into the groove (2) and retaining the cover layer on the cylinder at a tension uniformly applied over the axial length of the cylinder, said holding and securing means comprising, in accordance with the invention, a plurality of blind bores (4) formed in the bottom (3) of the groove (2) extending inwardly of the cylinder and uniformly distributed over the axial length of the cylinder;

a plurality of rod elements (9) coupled to said holding strip (11) and extending towards said blind bores;

a cover plate (6) formed with an opening to permit passage of said rod elements therethrough, covering the blind bores and sealing the blind bores against the bottom wall (3) of the groove;

solenoid means (24') electromagnetically coupled to said rod elements (9) and, upon energization, controlling the position of said rod elements; and circumferentially extending ledges (15, 16) extending from the outer end of said holding strip (11) at the same height, and from opposite sides thereof, and overlapping in part said recesses (13, 14) in the holding strip.

12. The system of claim 11, further including spring means (17, 17') acting on said rod elements (9) in a direction opposite the direction of force of the solenoid applied against said rod elements upon release of energization of the solenoid means (24').

13. The system of claim 11, wherein said rod elements (9) are directly coupled to the holding strip (11).

14. The system of claim 11, wherein said cover layer comprises a rubber blanket (24) having reinforced end portions (22, 23), said reinforced end portions fitting into the recesses (13, 14) of the strip.

15. The system of claim 14, wherein said extending ledges (15, 16) of said holding strip (11) overlap at least in part the reinforced end portions (22, 23) of the blanket (24).

* * * * *